US009782889B2

(12) United States Patent
Lemmey et al.

(10) Patent No.: US 9,782,889 B2
(45) Date of Patent: Oct. 10, 2017

(54) WEAR PROTECTION CAP

(71) Applicant: Wirtgen GmbH, Windhagen (DE)

(72) Inventors: Paul Anthony Lemmey, The Vines (AU); Brett George Roney, Ellenbrook (AU); Jamie Sinclair Moorby, Kewdale (AU)

(73) Assignee: Wirtgen GmbH (DE)

( * ) Notice: Subject to any disclaimer, the term of this patent is extended or adjusted under 35 U.S.C. 154(b) by 0 days.

(21) Appl. No.: 14/831,967

(22) Filed: Aug. 21, 2015

(65) Prior Publication Data

US 2016/0059405 A1 Mar. 3, 2016

(30) Foreign Application Priority Data

Sep. 1, 2014 (DE) ..... 10 2014 112 539

(51) Int. Cl.
*E21C 35/183* (2006.01)
*B25H 3/00* (2006.01)
*E21C 35/18* (2006.01)

(52) U.S. Cl.
CPC ..... *B25H 3/003* (2013.01); *E21C 35/18* (2013.01); *E21C 35/183* (2013.01); *E21C 2035/1803* (2013.01); *E21C 2035/1816* (2013.01)

(58) Field of Classification Search
CPC ..... E21C 2035/1803; E21C 2035/1806; E21C 2035/1816; E21C 35/18; E21C 35/183; E02F 3/8152; E02F 3/8157; E02F 9/2883
USPC ..... 37/451, 453; 172/719
See application file for complete search history.

(56) References Cited

U.S. PATENT DOCUMENTS 3,659,654 A * 5/1972 Davies ..... E02F 9/2875 172/699
3,856,359 A * 12/1974 Krekeler ..... E21C 35/183 299/104
4,428,131 A * 1/1984 Hahn ..... E02F 9/2841 172/713
4,561,698 A 12/1985 Beebe
(Continued)

FOREIGN PATENT DOCUMENTS

AU 2014227477 A1 4/2015
CN 1539047 A 10/2004
(Continued)

OTHER PUBLICATIONS

Australia Patent Examination Report No. 1 dated Feb. 26, 2016, in corresponding Australian Patent Application No. 2015218539, 5 pp. (not prior art).

(Continued)

*Primary Examiner* — David Bagnell
*Assistant Examiner* — Michael Goodwin
(74) *Attorney, Agent, or Firm* — Lucian Wayne Beavers; Patterson Intellectual Property Law, PC

(57) ABSTRACT

The invention relates to a wear protection cap for a bit holder arrangement, having at least two panel segments, located at an angle to one another, for covering surface regions of the bit holder arrangement, the panel segments being integrally joined to one another and the wear protection cap being configured as a cast metal part or as a forged metal part. With a wear protection cap of this kind, the service life of a bit holder arrangement can be substantially improved and machine stoppage time can be decreased.

12 Claims, 5 Drawing Sheets

(56) References Cited

U.S. PATENT DOCUMENTS

| | | | | |
|---|---|---|---|---|
| 4,716,667 | A * | 1/1988 | Martin | E02F 9/2841 172/772 |
| 4,932,723 | A | 6/1990 | Mills | |
| 6,619,757 | B1 | 9/2003 | Kammerer | |
| 6,644,755 | B1 | 11/2003 | Kammerer | |
| 7,073,870 | B2 | 7/2006 | Tillessen et al. | |
| 8,746,806 | B2 | 6/2014 | Lehnert et al. | |
| 8,770,669 | B2 | 7/2014 | Wachsmann et al. | |
| 8,783,785 | B2 | 7/2014 | Lehnert et al. | |
| 9,222,353 | B2 | 12/2015 | Morris et al. | |
| 2009/0174252 | A1 * | 7/2009 | Morris | E21C 35/1933 299/111 |
| 2012/0068526 | A1 | 3/2012 | Wachsmann et al. | |
| 2015/0028654 | A1 | 1/2015 | Lehnert et al. | |
| 2016/0059405 | A1 | 3/2016 | Lemmey et al. | |

FOREIGN PATENT DOCUMENTS

| | | | |
|---|---|---|---|
| CN | 1637231 | A | 7/2005 |
| CN | 101666229 | A | 3/2010 |
| CN | 101910525 | A | 12/2010 |
| CN | 102102516 | A | 6/2011 |
| CN | 102310488 | A | 1/2012 |
| CN | 102839976 | A | 12/2012 |
| CN | 103290770 | A | 9/2013 |
| CN | 204941539 | U | 1/2016 |
| DE | 3031609 | A1 | 4/1982 |
| DE | 3815249 | A1 | 10/1989 |
| DE | 3931838 | A1 | 4/1991 |
| DE | 19902766 | A1 | 8/2000 |
| DE | 20320161 | U1 | 3/2004 |
| DE | 102009059188 | A1 | 6/2011 |
| EP | 3048242 | A1 | 7/2016 |

OTHER PUBLICATIONS

European Search Report dated Mar. 10, 2016, in corresponding European Patent Application No. EP 15 18 1472, 8 pp. (not prior art).

Canadian Examination Report dated Sep. 1, 2016, in corresponding Canadian Patent Application No. 2,901,891, 4 pp. (not prior art).

China Notice and Search Report in corresponding Chinese Patent Application No. 201510551840.1, dated Mar. 20, 2017, 8 pp. (not prior art).

* cited by examiner 55
57
56
54
53
52
51
50

55
54
57
53
52
51
57

50
53
54
57
55
56

53
51
54
57
55
56
50
54
57

WEAR PROTECTION CAP

BACKGROUND OF THE INVENTION

1. Field of the Invention

The invention relates to a wear protection cap for a bit holder arrangement.

2. Description of the Prior Art

DE 10 2009 059 188 A1 (U.S. Pat. No. 8,746,806) discloses a bit holder arrangement. The latter encompasses a base part and a bit holder. The base part can be welded onto the outer surface of a tubular milling drum. The bit holder can then be replaceably fastened on the base part. A plurality of bit holder arrangements are secured on the surface of the tubular milling drum. They are preferably placed with respect to one another so that the base parts form a clearing and loading helix. A bit, preferably a rotatable round shank bit, can be replaceably received in the bit holder. The bit holder arrangements known from DE 10 2009 059 188 A1 are used in mining, preferably in open-cast mining. During processing use, the bits cut into the substrate that is to be removed, and detach material. The removed material flows off laterally past the bit and the bit holder and then arrives in the region of the base parts that form the clearing and loading helix. The base parts then therefore transport the removed material into the region of the center of the tubular milling drum, where it is then delivered to a loading belt.

Depending on its nature, the material produces different degrees of wear as a result of abrasion processes. Whereas rather less wear occurs with softer formations, such as coal, considerable wear can take place with materials containing iron ore. The bits are subjected to particularly severe wear and must therefore be changed at regular intervals. The bit holders, on the other hand, are designed to survive over the service life of a plurality of bits. The base part, constituting the most expensive unit of the bit holder arrangement, is intended to offer a particularly long service life. In order to delay cost-intensive replacement of the base parts, it is known from the existing art to weld facing plates, in the form of steel sheets, onto particularly threatened regions of the base parts. This procedure, upon initial population of a milling drum, is time-intensive, since a plurality of delicate components must be handled, but a longer service life can thereby be obtained. It has been found, however, that the sheets are subjected to increased wear especially in the region of the weld seams. The thermal effect resulting from the welding operation causes a reduction in the strength of the steel sheet in the region adjacent to the weld seam. Greater wear accordingly occurs here as compared with the other surface regions. The facing plates accordingly detach in uncontrolled fashion from the base part after a certain service time as a result of component failures. The use of additional welding material is time- and cost-intensive and thus increases part complexity.

Further wear protection systems are also known from the existing art. Hardface welds, for example, are applied directly onto bit holders or base parts of the bit holder arrangement. Effective wear protection can thereby be achieved, but the outlay for applying the welds is considerable.

SUMMARY OF THE INVENTION

An object of the invention is to furnish a wear protection system for a bit holder arrangement with which effective and long-lasting protection of the bit holder arrangement can be achieved.

This object is achieved with a wear protection cap that comprises at least two panel segments, located at an angle to one another, for covering surface regions of the bit holder arrangement, the panel segments being integrally joined to one another and the wear protection cap being configured as a primary-formed part, in particular a cast metal part, or as a reshaped part, in particular a forged metal part. Because the wear protection cap is configured as a cast metal part or forged metal part, uniform material properties can be achieved both in the region of the panel segments and in the region of the transitional regions joining the panel segments. Both the panel segments and the transitional regions between the panel segments thus offer the same material wear properties. In addition, the wear protection caps in the form of cast metal parts or forged metal parts allow for multifarious variant configurations that cannot be thus implemented with the known steel-sheet parts. For example, the panel segments can be configured in wear-optimized fashion with a different panel thickness, in particular a varying panel thickness profile. Zones of greater panel thickness can correspondingly be realized in regions in which greater wear occurs. Zones that are exposed to less abrasion, conversely, can be embodied in material-optimized fashion with a thinner cross section. Flow-optimized geometries individually matched to the utilization instance can moreover also be generated with the primary-formed or reshaped parts according to the present invention. This promotes lower-wear discharge of the removed material.

According to the present invention, the transitions between two panel segments can furthermore be embodied with a greater panel thickness than at least one of the panel segments, in order to offer particular wear protection there.

As mentioned previously, the wear protection cap can be configured as a forged metal part. The wear protection part can accordingly be configured as a cold-formed part or as a hot-formed part. A deep-drawn sheet part, for example, could be used as a cold-formed part. It is particularly preferred, however, to use a hot-formed part, in particular a forged part, since greater wear resistance values can thereby be achieved. In addition, more multifarious configuration possibilities, for example varying cross-sectional profiles, can be implemented with forged parts, as has been mentioned above.

A maximally continuous flow of removed material is advantageous in terms of low wear. Provision can accordingly be made, according to a variant of the invention, for at least some of the panel segments to lead into one another via radius transitions.

A particularly preferred variant of the invention provides that the panel segments are arranged in such a way that they are suitable for forming, during processing utilization, a positive join with the bit holder arrangement in the direction of the forces that impinge on the wear protection cap. A virtually self-securing design for the wear protection cap is thereby achieved. The wear protection cap can accordingly be fastened on the bit holder arrangement with securing means of simple configuration. In particular, these securing means can be accommodated in regions with a low risk of wear. In this context and also in connection with other variants of wear protection caps described in this patent application, welded joins, in particular linear tack welds or spot tack welds, which join the wear protection cap to the bit holder arrangement, can be used as securing means.

The wear protection cap can be configured in particular for use on a base part of the bit holder arrangement. Here it offers effective protection to the comparatively most expensive component of the bit holder arrangement.

For use of the wear protection cap on the base part, said cap can comprise a panel segment in the form of a top panel that transitions, via a transitional segment, into an enlargement, the enlargement transitioning, oppositely to the top panel, into a front panel constituting a further panel segment. This design protects the front region, at particularly high risk of wear, of a base part. The enlargement in the transitional region between the top panel and the panel segment provides additional wear volume in the interest of a long service life. Particularly preferably, the enlargement forms a radius transition in order to minimize abrasion processes here.

Provision can furthermore be made that two side panels arranged spaced apart from one another are configured as panel segments, and lead into the top panel via transitional segments. The side panels protect the side regions of the base part and are thus ultimately associated with the transport region of the clearing and loading helix of a milling drum. The side panels additionally form a positive engagement between the wear protection cap and the bit holder arrangement with respect to forces that impinge laterally. Enlargements can also be provided in the transitional region between the side panels and the top panel. The pitch of the spiral-shaped clearing and loading helices results in creation of a pressure side, facing toward the delivery region, at which particularly severe wear occurs. Provision of an enlargement in this region of the pressure side is particularly advantageous.

Provision can furthermore be made in the context of the invention that the top panel is set back in hollowed fashion by means of the transitional regions leading into the enlargements. An expansion region for the removed material being conveyed past is thereby formed, in the interest of lower abrasion. The enlargements furthermore offer a protective panel for those regions of the top panel located downstream oppositely to the motion direction, so that these regions are configured in wear-optimized fashion. In particular, a screw connection that secures a bit holder of the bit holder arrangement on the base part can, for example, then also be arranged in the hollowed region.

As mentioned above, the base parts can be secured in mutually adjacent fashion on the surface of the tubular milling drum in order to form a clearing and loading helix. In order to maintain the zero-clearance association of the base parts with one another, in a wear protection cap according to the present invention a recess is configured in the transitional region between the front panel and a laterally adjacent side panel. The base parts can be set alongside one another in the region of the recess.

In the context of the invention, the wear protection cap can also be configured for use on a bit holder of the bit holder arrangement. Provision can be made in particular that an aperture that is configured suitably for receiving a head of a shank bit is introduced into a panel segment configured as a front panel. The front panel protects the discharge region of the bit holder, which is configured around the head of the shank bit and is particularly at risk of wear. Particularly effective wear protection is thereby effected.

According to a variant of the invention, provision can furthermore be made that a further panel segment configured as a top panel is adjacent to the front panel on the rear side in angled fashion, the top panel forming at least locally a convex discharge surface. Discharge of the milled material on both sides of the bit holder can be brought about via the convex surface region, thereby achieving optimized material flow toward the clearing and loading helix.

According to a variant of the invention, provision can also be made that two side panels arranged spaced apart from one another, which are joined integrally to the top panel, are shaped onto the front panel on the rear side. The side panels protect the side region of the bit holder and moreover serve to stiffen the front panel with respect to the top panel.

A wear protection cap can also be configured, according to the present invention, in such a way that the front panel exhibits, adjacently to the aperture, a bevel extending at an inclination with respect to the longitudinal center axis of the aperture. With this bevel as well, improved material flow can be achieved.

BRIEF DESCRIPTION OF THE DRAWINGS

The invention will be explained in more detail below with reference to exemplifying embodiments depicted in the drawings, in which.

DETAILED DESCRIPTION

Figure 1:
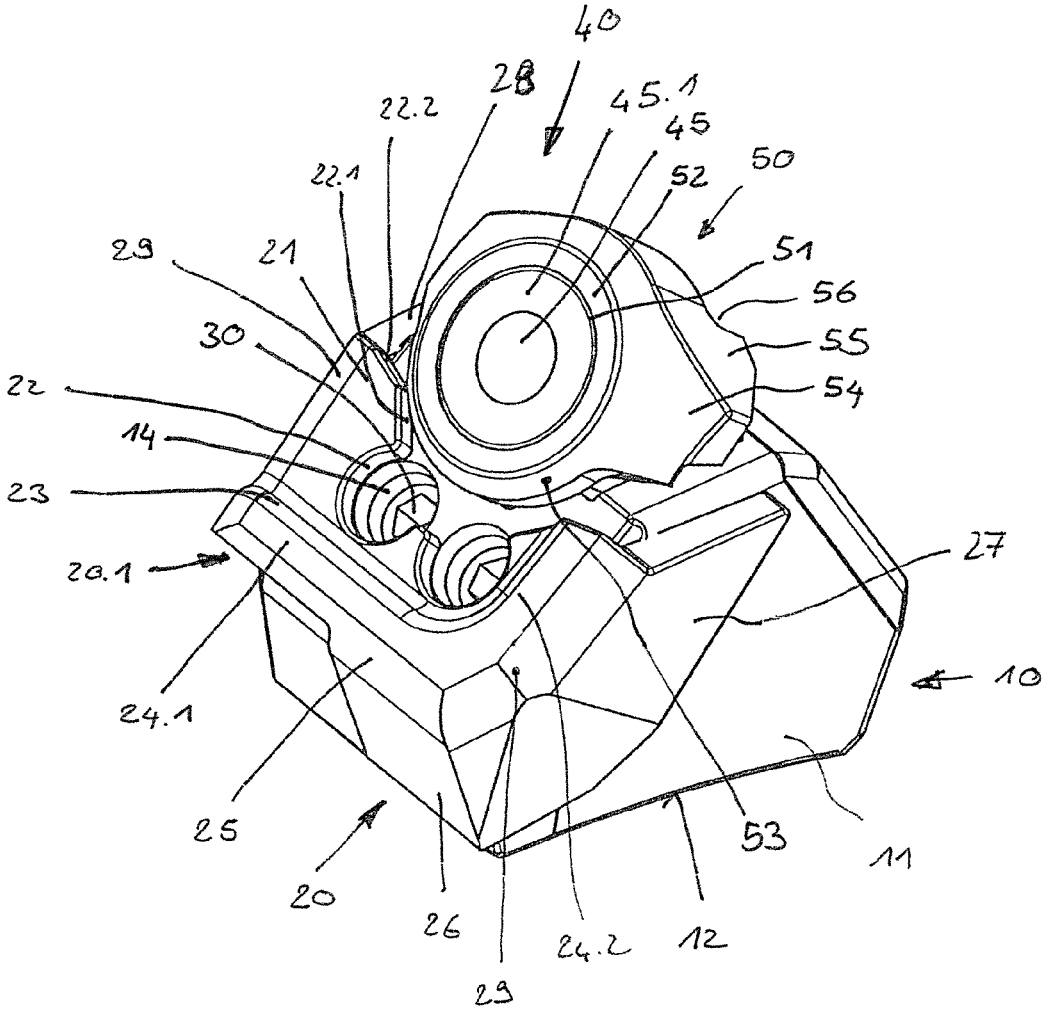
FIG. 1 is a perspective view of a bit holder arrangement having wear protection caps.

FIG. 1 shows a bit holder arrangement that is typically utilized in a surface miner. The bit holder arrangement comprises a base part 10 and a bit holder 40.

Base part 10 will be explained in further detail below with reference to FIG. 2. As depicted therein, base part 10 is configured in one piece and has two side parts 11. These are arranged spaced apart from one another. An insertion receptacle 13 is formed between side parts 11. In the region of its underside 12, base part 10 is provided with a concave surface. With this concave surface, base part 10 can be placed flush onto the surface of a tubular milling drum (not depicted). It can be secured there on the tubular milling drum with weld seams. Base part 10 has in the region of its front side, adjacently to side parts 11, a frontal projection. This projection is delimited at the front by a front surface 15 and by a further front surface 16. The two front surfaces 15 and 16 are located at an angle to one another and lead into one another via a transitional segment 15.1. Transitional segment 15.1 is embodied as a radius transition. In the region of front surface 15, two threaded receptacles 14, arranged spaced apart in parallel fashion from one another, are introduced into the front-side projection of base part 10. Threaded receptacles 14 terminate in the region of insertion receptacle 13. As is further evident from FIG. 2, the outer surfaces of side parts 11 lead via radius transitions 15.2 into front surfaces 15 and 16. In the region of insertion receptacle 13, the frontal projection forms two support surfaces 13.1 located at an angle to one another. Support surfaces 13.1 can be configured as flat surfaces. At the rear, insertion receptacle 13 is likewise delimited by two support surfaces 13.2. These two support surfaces 13.2 can likewise be of planar configuration and can extend in the direction of the longitudinal center axis of insertion receptacle 13. Base part 10 terminates in the region of its rear side with a rearward panel that forms a rear-side terminating surface 17.

Wear protection cap 20 can be installed onto base part 10. As is evident from FIG. 2, wear protection cap 20 is configured in one piece. It comprises a top panel 21 that transitions at the front, via a rising transitional region 23, into an enlargement 24.1. Enlargement 24.1 serves to increase the material thickness of wear protection cap 20. Wear protection cap 20 correspondingly has, in the region of enlargement 24.1, a greater panel thickness than top panel 21. On the side, top panel 21 likewise transitions via a transitional region 23 into an enlargement 24.2. Here as well, a thickened cross-sectional region is consequently formed. Top panel 21 is equipped with two arc-shaped recesses 22. These recesses 22 transition into edge segments 22.1 that are set in a V-shape with respect to one another. Edge segments 22.1 end in further edge segments 22.2. Wear protection cap 20 comprises two side panels 27 and 28 that are arranged spaced apart from one another. Wear protection cap 20 terminates at the front side in a front panel 26. Side panels 27, 28 respectively transition via radius transitions 29 into the top side of wear protection cap 20. Side panel 28 transitions via radius transition 29 directly into top panel 21. Side panel 27 transitions via radius transition 29 into enlargement 24.2. Front panel 26 furthermore transitions via radius transition 25 into enlargement 24.1.

Figure 2:
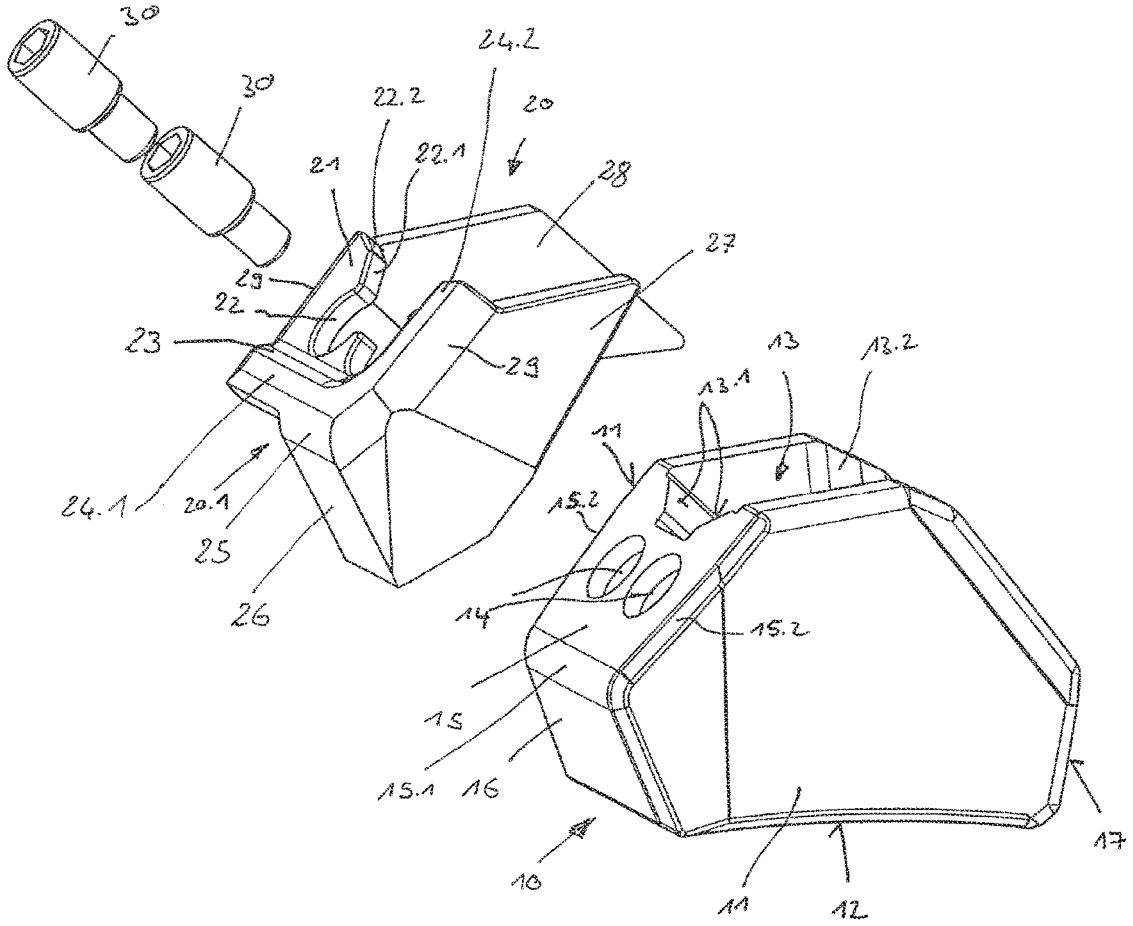
FIG. 2 is a perspective exploded view of the bit holder arrangement according to FIG. 1 having a wear protection cap.
Figure 4:
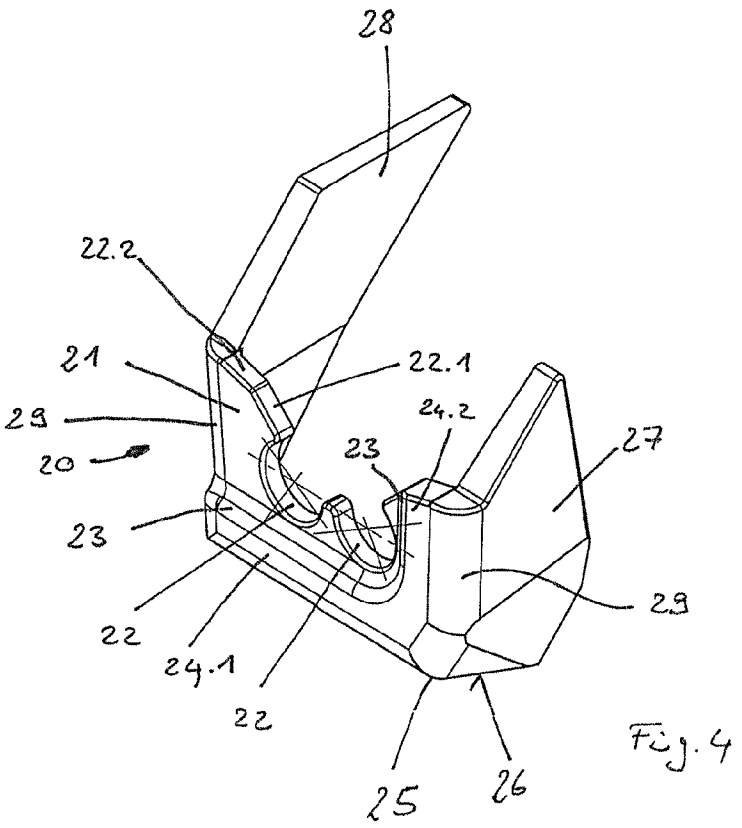
FIGS. 3 and 4 show various views of the wear protection cap according to FIG. 2.
Figure 3:
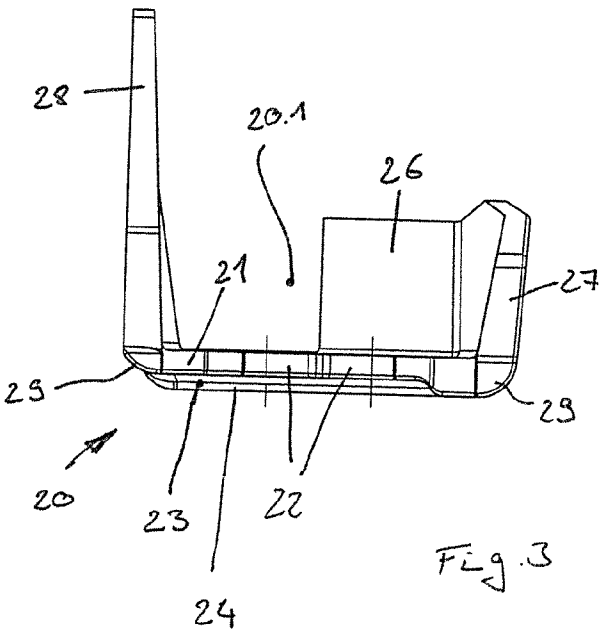

It is furthermore evident from FIG. 2 that wear protection cap 20 comprises a recess 20.1 in the region of front panel 26 and in the front side region of side panel 28.

For installation of wear protection cap 20, the latter is placed over base part 10, the two side panels 27 and 28 coming to rest against the outer sides of side parts 11. Top panel 21 rests with its rear side on front surface 15. Front panel 26 rests at the rear on front surface 16. In the region of recess 20.1, base part 10 stands clear at the corner transition between front surface 16 and the outer side of side part 11. In this region, a further base part 10 that is not depicted in the drawings is set alongside in order to form the clearing and loading helix on the tubular milling drum. The two recesses 22 leave threaded receptacles 14 exposed. Welded joins are used to fasten wear protection cap 20 on base part 10. These can be placed, for example, at locations that are favorable in terms of wear. In particular, for example, linear tack welds can be provided in the region of side panels 27, 28.

Figure 5:
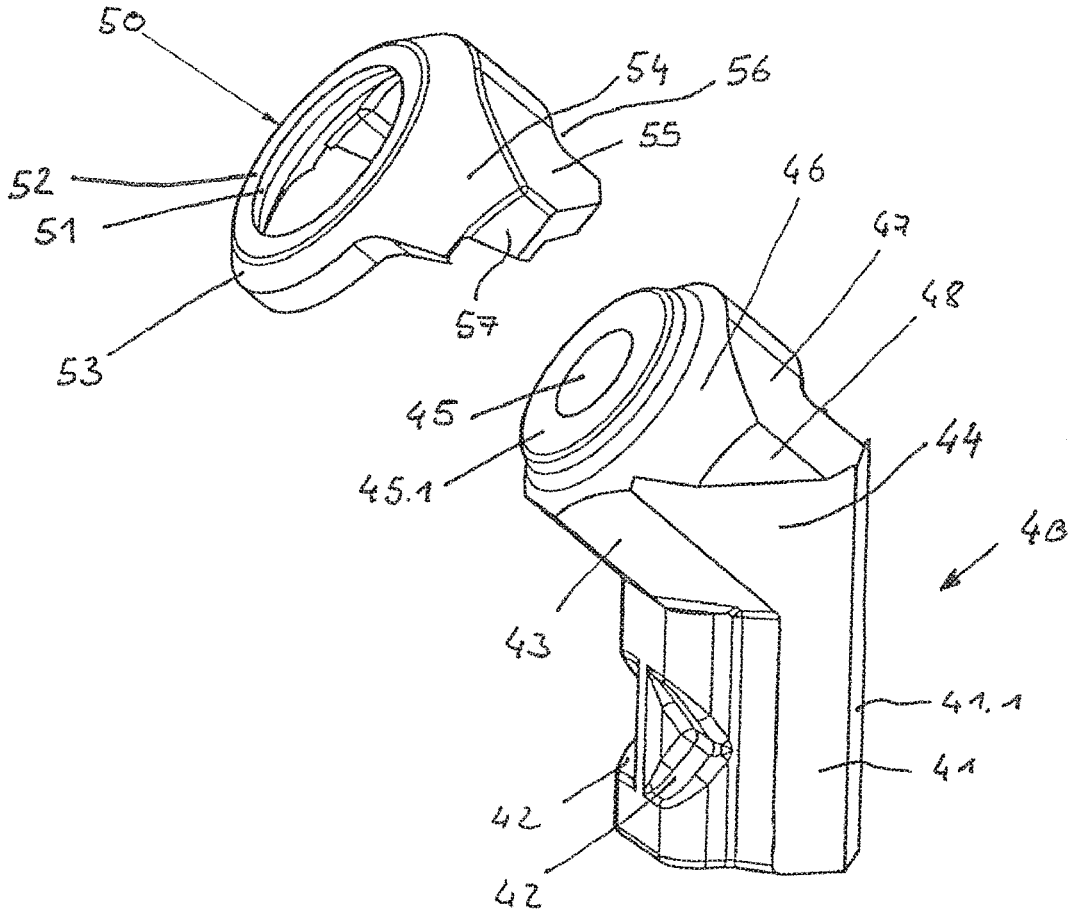
FIG. 5 is a perspective depiction of a bit holder of the bit holder arrangement according to FIG. 1 together with a wear protection cap.

FIG. 5 is a perspective exploded depiction of bit holder 40 of the bit holder arrangement. As is evident from this depiction, bit holder 40 has a holding projection 44 on which an insertion projection 41 is integrally shaped. Holding projection 44 comprises a bit receptacle 45 in the form of a bore. An annular seating surface 45.1 is arranged around the bore entrance of bit receptacle 45. Adjacently to seating surface 45.1, holding projection 44 forms a discharge surface 46 extending at an inclination to the longitudinal center axis of bit receptacle 45. Discharge surface 46 transitions on the top side into an enveloping surface 47 and on the side into side parts 48. Holding projection 44 comprises, in the region of its underside, two support surfaces 43 arranged at an angle to one another.

Insertion projection 41 has at the rear two bearing surfaces 41.1 set at an angle to one another. Insertion projection 41 is equipped in the region of the front side with two pressure surfaces 42. Pressure surfaces 42 extend at an angle of less than 90° with respect to the longitudinal center axis of insertion projection 41. Bit holder 40 can be installed onto base part 10. For this, bit holder 40 is inserted with its insertion projection 41 into insertion receptacle 13 of base part 10. In the assembled state, bit holder 40 is braced with its bearing surfaces 41.1 flush against support surfaces 13.2, and with its two support surfaces 43 flush against support surfaces 13.1. Two fastening bolts 30 (see FIG. 2) are threaded into screw receptacles 14 in order to secure bit holder 40. Pressure projections of fastening bolts 30 then act on pressure surfaces 42 of bit holder 40, and bit holder 40 is pressed with its support surfaces 43 and with bearing surfaces 41.1 onto the corresponding support surfaces 13.1, 13.2 of base part 10. Bit holder 40 can be installed once wear protection cap 20 is installed.

Figures 6A, 6B, 6C, 6D, 6E:
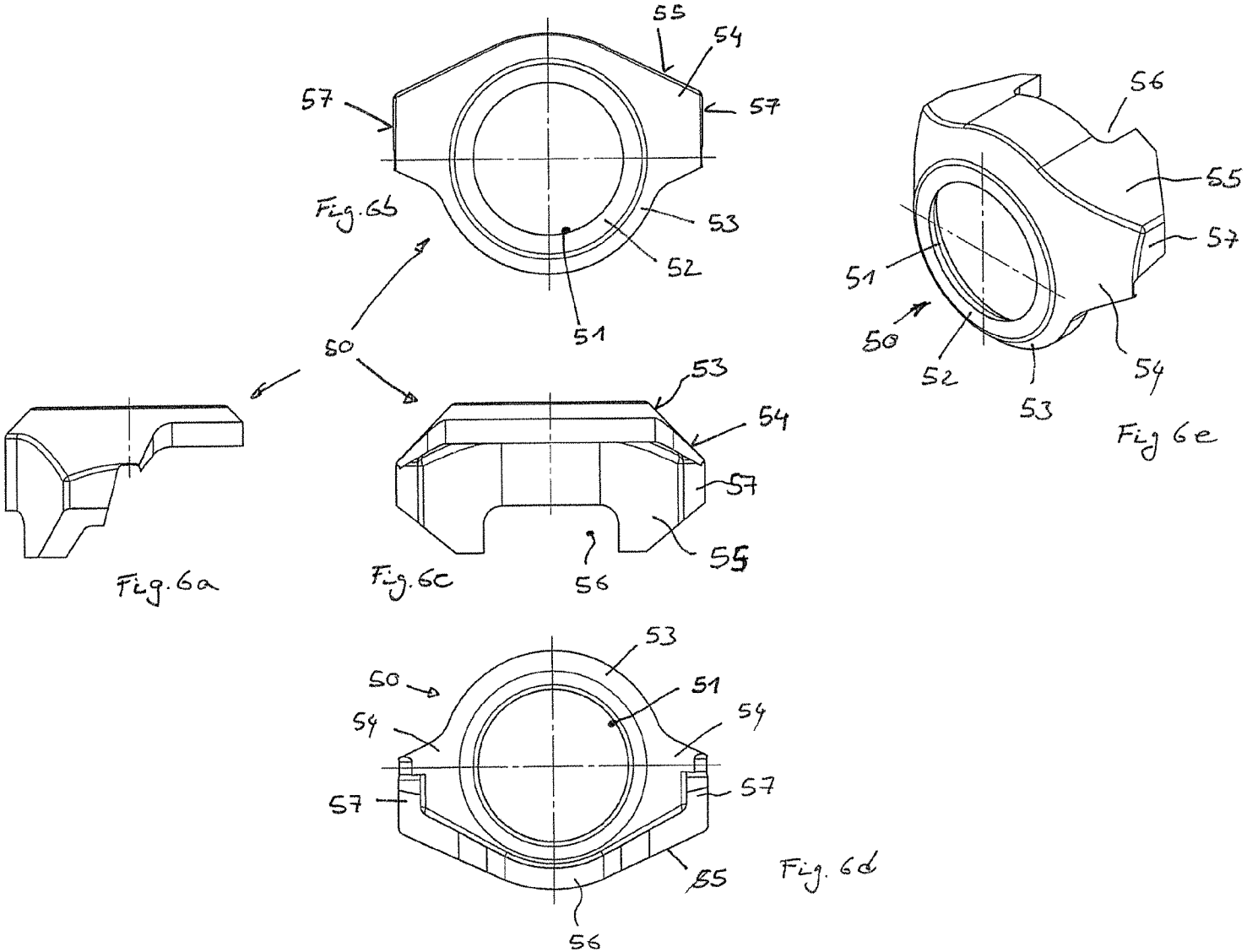
FIGS. 6*a* to 6*e* show various views of the wear protection cap according to FIG. 5.

As is further evident from FIG. 5, a wear protection cap 50 can also be installed on bit holder 40. This wear protection cap 50 is shown in further detail in FIGS. 6*a* to 6*e*. Wear protection cap 50 accordingly comprises a front panel 54 that is penetrated by an aperture 51. Aperture 51 is delimited by an annularly surrounding rim 52. Adjacently to rim 52, front panel 54 comprises a bevel 53. Front panel 54 forms laterally protruding wing-like extensions, as are evident e.g. from FIG. 6*b*. Side panels 57 projecting rearward are shaped on integrally in the region of the free ends of the wing-shaped extensions. Side panels 57 are likewise joined integrally to a top panel 55. Top panel 55 is also joined integrally to front panel 54. As is evident from FIGS. 6*b* and 6*e*, front panel 54 comprises a convex elevation. A recess 56 is provided at the rear in the region of the convex elevation.

It is further evident from FIG. 5 that wear protection cap 50 is placed onto bit holder 40. Front panel 54 sits with its rear side on discharge surface 46. Top panel 55 is braced on enveloping surface 47. The two side panels 57 are located opposite the outer sides of side parts 48. Weld seams are again provided, at locations favorable in terms of wear, in order to fasten wear protection cap 50. These seams join wear protection cap 50 to bit holder 40. In the assembled state, aperture 51 offers wear protection cap 50 access to bit receptacle 45. Aperture 51 is furthermore dimensioned in such a way that seating surface 45.1 is exposed. A round shank bit can thus be joined to bit holder 40. The round shank bit can be held with its round shank in bit receptacle 45, the round shank bit simultaneously being braced with its bit head on seating surface 45.1.

When wear protection caps 20 and 50 wear away during operational utilization, they can be replaced as necessary. This requires merely severing the joining means, for example the linear tack welds in this case. This can be effected on site using a corresponding cutting device. The worn-out wear protection caps 20 and 50 can then be replaced with new wear protection caps 20, 50. The latter are then again fastened on base part 10 and on bit holder 50. This repair action can be carried out on a short repair time scale, so that machine stoppage times are reduced.

Wear protection cap 20 comprises, in the context of the invention, side panels 27, 28, front panel 26, and top panel 21 as panel segments. Wear protection panel 50 comprises, in the context of the invention, front panel 54, top panel 55, and side panels 57 as panel segments. The panel segments of wear protection caps 20 and 50 are joined integrally to one another; the wear protection caps can be embodied as a cast metal part or as a forged metal part.

The invention claimed is:

1. A wear protection cap for a bit holder arrangement, the wear protection cap comprising:

at least two panel segments located at an angle to one another for covering surface regions of the bit holder arrangement, the panel segments being integrally joined to one another as a primary-formed metal part or as a reshaped metal part, the at least two panel segments including a front panel segment, a top panel segment, and two side panel segments;

a first transitional region between the top panel segment and the front panel segment, the first transitional region being of enlarged thickness relative to the top panel segment;

a second transitional region between the top panel segment and at least one of the side panel segments, the second transitional region joining the first transitional region, the second transitional region being of enlarged thickness relative to the top panel segment; and wherein the top panel segment is recessed from the first and second transitional regions of enlarged thickness.

2. The wear protection cap of claim 1, wherein:

the wear protection cap is formed as a hot formed part, either as a cast part or as a forged part.

3. The wear protection cap of claim 1, wherein:

at least one of the panel segments leads into another of the panel segments via a radius transition.

4. The wear protection cap of claim 1, wherein:

the top and front panel segments are arranged to rest on corresponding flat support surfaces of a base part of the bit holder arrangement to support the wear protection cap against forces that impinge on the wear protection cap during use of the bit holder arrangement.

5. The wear protection cap of claim 1, wherein:

the wear protection cap is configured for covering surface regions of a base part of the bit holder arrangement.

6. The wear protection cap of claim 1, wherein:

the wear protection cap has a recess defined therein between the front panel segment and one of the side panel segments, the recess extending through the first transitional region of enlarged thickness.

7. A wear protection cap for a bit holder arrangement, the wear protection cap comprising:

at least two panel segments located at an angle to one another for covering surface regions of the bit holder arrangement, the panel segments being integrally joined to one another as a primary-formed metal part or as a reshaped metal part, the at least two panel segments including a front panel segment, a top panel segment, and two side panel segments;

a first transitional region between the top panel segment and the front panel segment, the first transitional region being of enlarged thickness relative to the top panel segment;

a second transitional region between the top panel segment and at least one of the side panel segments, the second transitional region joining the first transitional region, the second transitional region being of enlarged thickness relative to the top panel segment; and wherein the wear protection cap has a recess defined therein between the front panel segment and one of the side panel segments, the recess extending through the first transitional region.

8. The wear protection cap of claim 7, wherein:

the wear protection cap is formed as a hot formed part, either as a cast part or as a forged part.

9. The wear protection cap of claim 7, wherein:

the front panel segment leads into the top panel segment via a radius transition.

10. The wear protection cap of claim 7, wherein:

the top and front panel segments are arranged to rest on corresponding flat support surfaces of a base part of the bit holder arrangement to support the wear protection cap against forces that impinge on the wear protection cap during use of the bit holder arrangement.

11. A wear protection cap for covering surface regions of a bit holder of a bit holder arrangement, the wear protection cap comprising:

at least two panel segments located at an angle to one another for covering surface regions of the bit holder arrangement, the panel segments being integrally joined to one another as a primary-formed metal part or as a reshaped metal part, the at least two panel segments including:

a front panel segment having an aperture defined therein, the aperture configured to receive a head of a shank bit;

a top panel segment adjacent to a rear side of the front panel segment, the top panel segment including a convex discharge surface; and two side panel segments, the side panel segments being spaced apart from one another and being joined integrally to the top panel segment and to a rear side of the front panel segment, the convex discharge surface of the top panel segment extending from one side panel segment to the other side panel segment.

12. The wear protection cap of claim 11, wherein:

the wear protection cap is formed as a hot formed part, either as a cast part or as a forged part.

* * * * *